US007950944B1

(12) United States Patent
Hertzler et al.

(10) Patent No.: US 7,950,944 B1
(45) Date of Patent: May 31, 2011

(54) ELECTRICAL CONNECTOR HAVING A LOCKING COLLAR

(75) Inventors: Christopher Scott Hertzler, Carlisle, PA (US); Osenaga Osagie, Harrisburg, PA (US); Kyle Thompson, Lancaster, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/544,875

(22) Filed: Aug. 20, 2009

(51) Int. Cl.
*H01R 13/62* (2006.01)

(52) U.S. Cl. ..... 439/314

(58) Field of Classification Search ..... 439/317, 439/312, 313, 314, 318
See application file for complete search history.

(56) References Cited

U.S. PATENT DOCUMENTS

| | | | | |
|---|---|---|---|---|
| 5,662,488 | A * | 9/1997 | Alden | 439/314 |
| 7,270,560 | B1 | 9/2007 | Bodmann et al. | |
| 7,632,126 | B1 * | 12/2009 | Farole et al. | 439/314 |
| 2006/0025008 | A1 | 2/2006 | Beck et al. | |

FOREIGN PATENT DOCUMENTS

| | | |
|---|---|---|
| DE | 203 12 211 | 10/2003 |
| DE | 20 2005 00 970 | 6/2005 |
| DE | 10 2005 048 248 | 4/2007 |
| EP | 1 653 570 | 5/2006 |
| EP | 2 071 677 | 6/2009 |

OTHER PUBLICATIONS

European Search Report, International Application No. EP 10 17 3183.

* cited by examiner

*Primary Examiner* — Phuong K Dinh

(57) ABSTRACT

An electrical connector is provided for mating with a mating connector. The electrical connector includes a housing and an electrical contact held by the housing. The housing has a mating end that faces the mating connector when the electrical connector is mated with the mating connector. The housing includes a body having a retaining flange. A locking collar is movably mounted on the body of the housing. The locking collar includes a locking element and an inwardly directed shoulder having an opening extending therethrough. The locking element is configured to engage the mating connector to lock the electrical connector to the mating connector. The shoulder engages the retaining flange of the body when the locking collar is fully engaged with the mating connector. The retaining flange of the body is configured to engage the locking element of the locking collar to retain the locking collar on the body of the housing.

19 Claims, 6 Drawing Sheets

ELECTRICAL CONNECTOR HAVING A LOCKING COLLAR

BACKGROUND OF THE INVENTION

The subject matter described and/or illustrated herein relates generally to electrical connectors, and more particularly, to electrical connectors having locking collars for mechanically connecting the electrical connector to a mating connector.

Many electrical connectors suffer from a relatively low resistance to disengagement from a mating connector. For example, an axial pull-out force necessary to disengage a Universal Serial Bus (USB) connector from another complementary USB connector may be relatively low. Electrical connectors having relatively low axial pull-out forces may be unintentionally disengaged from the mating connector, for example when a cable is inadvertently pulled or snagged and/or when the electrical connector is bumped into. USB connectors that terminate flash drives, wireless antennas, and/or other stand-alone components can be particularly susceptible to unintentional disengagement because the stand-alone component often extends outwardly from the device to which the USB connector is mated. For example, when the device is mobile, such as a laptop computer, or there is heavy traffic around the device, such as with some relatively large machines, the stand-alone component can easily be bumped into by a person or object.

To secure the electrical connector to the mating connector, some electrical connectors include a locking collar that extends around a housing of the electrical connector and mechanically connects to a housing of the mating connector. However, known locking collars are held on the housing of the electrical connector using a separate component from the housing, such as a spring clip, retaining ring, tie wrap, or similar component. Using such a separate component from the housing of the electrical connector may increase a cost, complexity, and/or assembly time of the electrical connector.

BRIEF DESCRIPTION OF THE INVENTION

In one embodiment, an electrical connector is provided for mating with a mating connector. The electrical connector includes a housing and an electrical contact held by the housing. The housing has a mating end that faces the mating connector when the electrical connector is mated with the mating connector. The housing includes a body having a retaining flange. A locking collar is movably mounted on the body of the housing. The locking collar includes a locking element and an inwardly directed shoulder having an opening extending therethrough. The locking element is configured to engage the mating connector to lock the electrical connector to the mating connector. The shoulder engages the retaining flange of the body when the locking collar is fully engaged with the mating connector. The retaining flange of the body is configured to engage the locking element of the locking collar to retain the locking collar on the body of the housing.

In another embodiment, an electrical connector is provided for mating with a mating connector. The electrical connector includes a housing and an electrical contact held by the housing. The housing has a mating end that faces the mating connector when the electrical connector is mated with the mating connector. The housing includes a retaining flange having a loading element. A locking collar is movably mounted on the housing. The locking collar includes a locking element configured to engage the mating connector to lock the electrical connector to the mating connector. The locking element of the locking collar and the loading element of the retaining flange are to engage each other in a press-fit relationship for loading and retaining the locking collar on the housing.

DETAILED DESCRIPTION OF THE INVENTION

Figure 1:
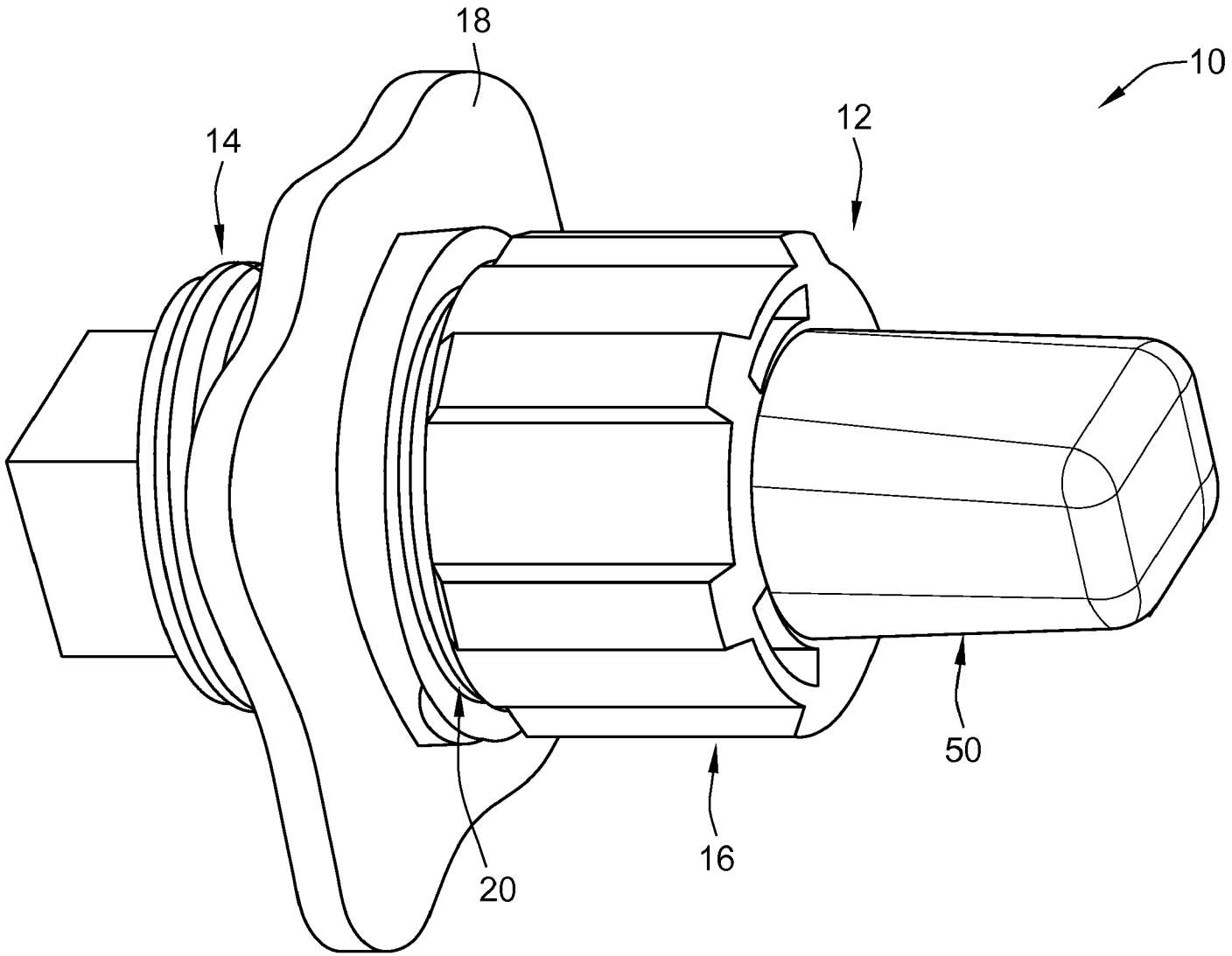
FIG. 1 is a perspective view of an assembly of an exemplary embodiment of an electrical connector and an exemplary mating connector.

FIG. 1 is a perspective view of an assembly 10 of an exemplary embodiment of an electrical connector 12 and an exemplary mating connector 14. The connectors 12 and 14 mate together to establish an electrical connection therebetween. A locking collar 16 of the electrical connector 12 mechanically connects to a housing 20 of the mating connector 14 to lock the electrical connector 12 and the mating connector 14 together.

In the exemplary embodiment, the electrical connector 12 is a male universal serial bus (USB) connector (such as, but not limited to, a USB 2.0 connector, a USB 3.0 connector, and/or the like), and the mating connector 14 is a female USB connector (such as, but not limited to, a USB 2.0 connector, a USB 3.0 connector, and/or the like). Moreover, in the exemplary embodiment, the electrical connector 12 is a wireless communication adapter, such as, but not limited to, a Bluetooth® adapter (when such an adapter includes a USB, the adapter is sometimes referred to as a "Bluetooth USB dongle") and/or the like. However, the connectors 12 and 14 may each be any other type of connector, such as, but not limited to, other serial connectors, modular plugs and modular jacks, coaxial connectors, audio connectors, video connectors, and/or the like. In some alternative embodiments, the electrical connector 12 is a female connector and the mating connector 14 is a male connector.

In the exemplary embodiment, the housing 20 of the mating connector 14 is mounted on a structure. Specifically, the housing 20 is mounted within an exemplary panel 18 of a larger system of which the mating connector 14 is a component thereof, such as, but not limited to, a computer, a machine, a server, and/or the like. The panel 18 may form any portion of the larger system, such as, but not limited to, a housing, rack, support structure, wall, and/or the like of the larger system. Alternatively, the panel 18 may be a stand-alone panel that does not form a portion of a larger system. Moreover, in some alternative embodiments the housing 20 of the mating connector 14 is not mounted on another structure.

Although shown herein as a separate structure that is mechanically connected to the panel 18, in some alternative embodiments the housing 20 of the mating connector 14 is an integral portion of the panel, housing, rack, support structure, wall, and/or the like to which the housing 20 is mounted. For example, the housing 20 of the mating connector 20 is optionally an integral portion of the panel 18.

Figure 2:
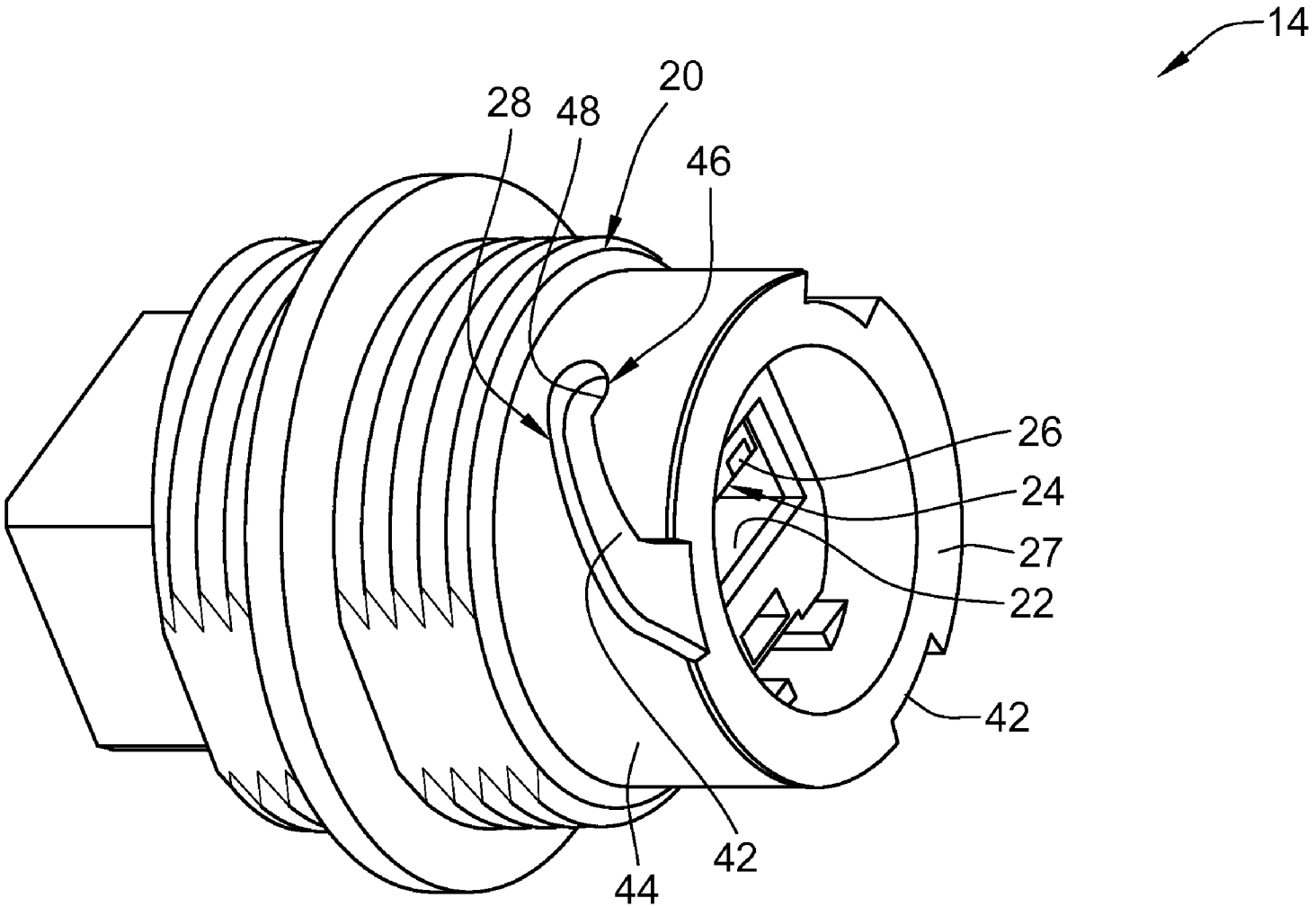
FIG. 2 is a perspective view of the exemplary mating connector.

FIG. 2 is a perspective view of the mating connector 14. In the exemplary embodiment, the mating connector 14 includes the housing 20, an outer electrical contact 22, and an inner electrical contact assembly 24. The inner electrical contact assembly 24 includes a plurality of inner electrical contacts 26 (only one inner electrical contact 26 is visible in FIG. 2). The mating connector 14 may include any number of electrical contacts overall, including any number of inner electrical contacts 26 and any number of outer electrical contacts 22. For example, in some embodiments the mating connector 14 does not include any outer electrical contacts or does not include any inner electrical contacts.

The housing 20 of the mating connector 14 includes a mating face 27 and one or more mechanical connection elements 28. The mechanical connection elements 28 cooperate with one or more locking elements 30 (FIG. 3) of the locking collar 16 (FIGS. 1, 3, 4, and 6) of the electrical connector 12 (FIGS. 1, 3, 4, and 6) to mechanically connect the housing 20 to the locking collar 16, and thereby lock the electrical connector 12 to the mating connector 14. In the exemplary embodiment, the locking collar 16 and the housing 20 mechanically connect using a bayonet type connection. Specifically, the connection elements 28 of the mating connector housing 20 include threads 42 that extend at least partially around an exterior surface 44 of the housing 20 along a spiral path. Each thread 42 extends about the exterior surface 44 of the housing 20 to an end 46 that includes a recess 48.

Figure 3:
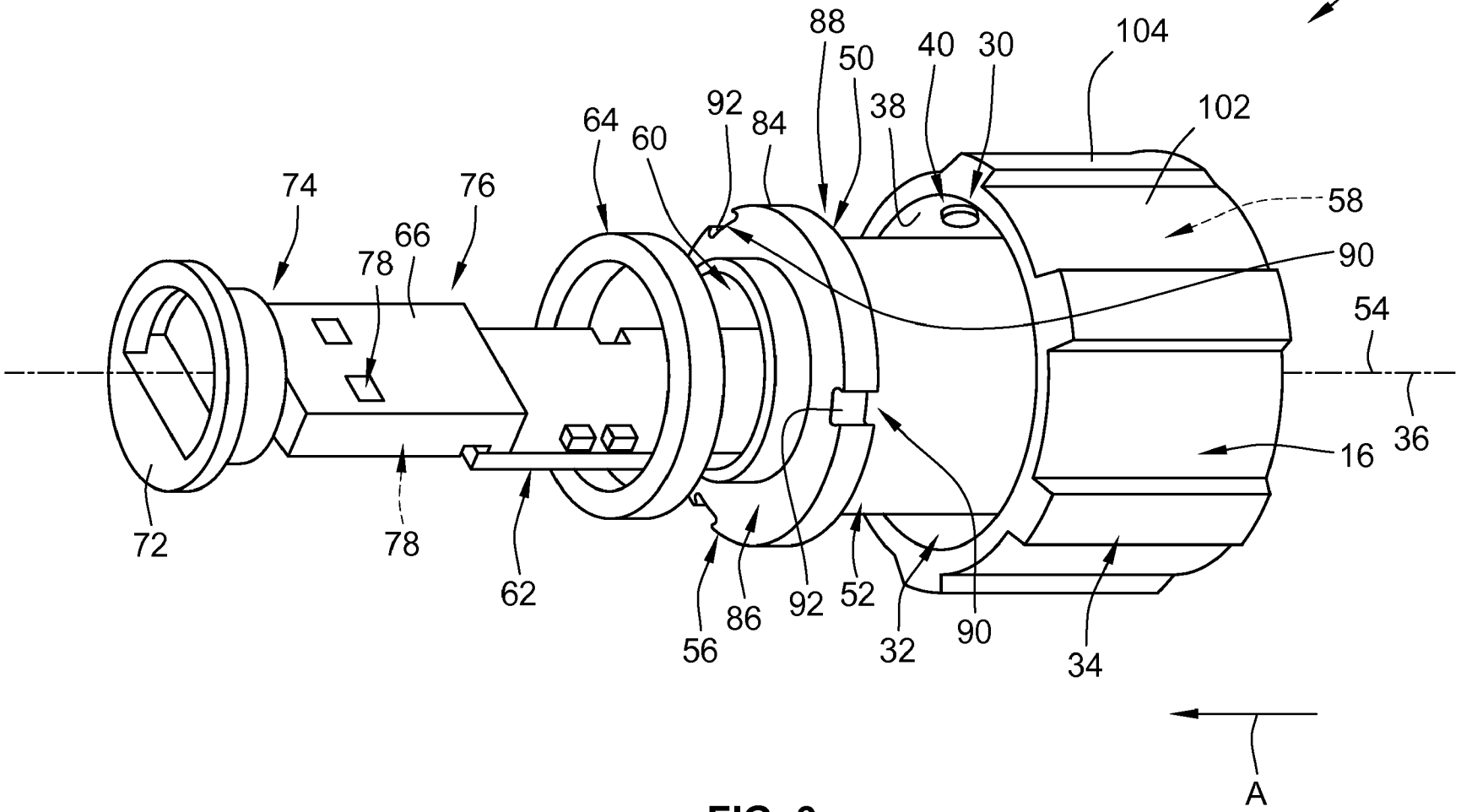
FIG. 3 is an exploded perspective view of the electrical connector shown in FIG. 1 illustrating an exemplary embodiment of a locking collar of the electrical connector unloaded from an exemplary embodiment of a housing of the electrical connector.

FIG. 3 is an exploded perspective view of the electrical connector 12. The locking collar 16 includes a body 34 having an interior cavity 32. The body 34 of the locking collar 16 extends a length along a central longitudinal axis 36. An interior surface 38 of the body 34 defines the interior cavity 32 of the locking collar 16. In the exemplary embodiment, the locking elements 30 of the locking collar 16 include projections 40 that extend from the interior surface 38 radially inwardly relative to the central longitudinal axis 36.

Referring now to FIGS. 2 and 3, to mechanically connect the locking collar 16 to the housing 20 of the mating connector 14, the housing 20 is received within the interior cavity 32 of the locking collar 16 and the projections 40 are received within the threads 42. The locking collar 16 is rotated about the central longitudinal axis 36 and the mating connector housing 20 such that the projections 40 travel along the path of the threads 42 to the ends 46, which also pulls the housing 20 further within the interior cavity 32 of the locking collar 16. At the ends 46, the projections 40 slide into the recesses 48 of the threads 42 such that the locking collar is fully engaged with the mating connector housing 20 to hold the locking collar 16 on the housing 20.

In addition or alternative to the threads 42 and/or the projections 40, the mating connector housing 20 may include one or more projections (not shown) that are received within one or more threads (not shown) extending within the interior surface 38 of the locking collar 16. Although three projections 40 are shown, the locking collar 16 may include any number of locking elements 30 and the mating connector housing 20 may include any number of connection elements 28. Other types of mechanical connections besides a bayonet connection may be used so long as the mechanical connection includes some form of a projection that is received within some form of an opening. In some embodiments, the bayonet type connection between the locking collar 16 and the mating connector housing 20 is defined by International Electrotechnical Commission (IEC) 61076-3-106 Variant 1.

Figure 4:
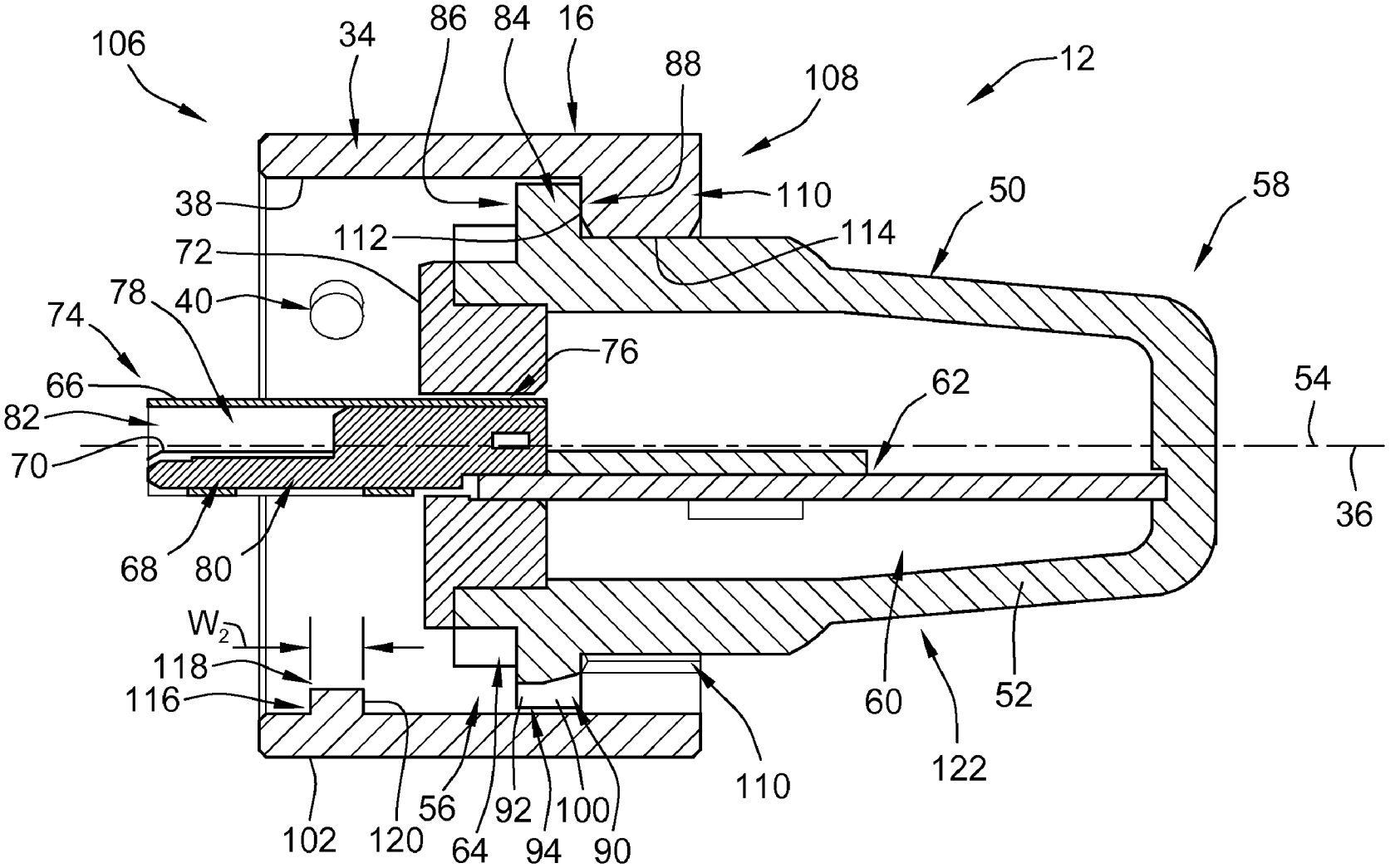
FIG. 4 is a cross-sectional view of the electrical connector shown in FIGS. 1 and 3 illustrating the locking collar loaded on an exemplary embodiment of a housing of the electrical connector.

FIG. 4 is a cross-sectional view of the electrical connector 12 illustrating the locking collar 16 loaded on an exemplary embodiment of a housing 50 of the electrical connector 12. Referring now to FIGS. 3 and 4, the electrical connector 12 includes the housing 50, which includes a body 52 extending a length along a central longitudinal axis 54 from a mating end 56 to a closed end 58. An interior chamber 60 extends through the mating end 56 and into the housing 50 to the closed end 58. The interior chamber 60 is configured to hold one or more electrical components 62. In the exemplary embodiment, the electrical components 62 are wireless communication adapter components, such as, but not limited to, Bluetooth® adapter components and/or the like. In addition or alternative, the interior chamber 60 may hold any other type of electrical components. When the electrical connector 12 is mated with the mating connector 14 (FIGS. 1 and 2), the mating end 56 of the housing 50 faces the mating face 27 (FIGS. 1 and 2) of the mating connector housing 20 (FIGS. 1 and 2). Optionally, the housing 50 holds a gasket 64 for sealing the mating end 56 of the housing 50 with the mating face 27 of the mating connector housing 20.

The electrical connector 12 includes an outer electrical contact 66 and an inner electrical contact assembly 68 (not visible in FIG. 3), which includes a plurality of inner electrical contacts 70 (not visible in FIG. 3). The electrical connector 12 may include any number of electrical contacts overall, including any number of inner electrical contacts 70 and any number of outer electrical contacts 66. For example, in some embodiments the electrical connector 12 does not include any outer electrical contacts or does not include any inner electrical contacts. The outer electrical contact 66 is held by a cover 72 that is held within the interior chamber 60 of the housing 50 at the mating end 56 thereof. The outer electrical contact 66 extends a length from a mating end 74 to a rear end 76. The outer electrical contact 66 is held by the cover 72 such that the rear end 76 extends within the interior chamber 60 and the mating end 74 extends outwardly from the mating end 56 of the housing 50. The outer electrical contact 66 engages the outer electrical contact 22 (FIG. 2) of the mating connector 14 when the connectors 12 and 14 are mated together to establish an electrical connection between the outer electrical contacts 66 and 22.

The outer electrical contact 66 includes an interior chamber 78. The inner electrical contact assembly 68 includes an electrically insulating holder 80 (not visible in FIG. 3) held within the interior chamber 78 of the outer electrical contact 66. The holder 80 holds the inner electrical contacts 70 within the interior chamber 78 of the outer electrical contact 66. The holder 80 electrically insulates the outer electrical contact 66 from the inner electrical contacts 70. Each inner electrical contact 70 includes a mating interface 82 (not visible in FIG. 3) that engages a corresponding one of the inner electrical contacts 26 (FIG. 2) of the mating connector 14 when the connectors 12 and 14 are mated together. An electrical connection between the inner electrical contacts 70 and 26 is established by the engagement therebetween.

The body 52 of the housing 50 of the electrical connector 12 includes a retaining flange 84 that extends radially outward relative to the central longitudinal axis 54. As will be described below, the retaining flange 84 facilitates retaining the locking collar 16 on the housing 50 of the electrical connector 12. The retaining flange 84 extends a length from a mating side 86 to an opposite rear side 88. In the exemplary embodiment, the retaining flange 84 extends radially outwardly at the mating end 56 of the housing 50. However, the retaining flange 84 may additionally or alternatively extend radially outwardly along any other portion of the length of the housing 50, for example at the closed end 58 and/or at any location(s) along the length of the housing 50 between the mating end 56 and the closed end 58.

The retaining flange 84 of the housing 50 includes one or more loading elements 90 that enable the locking collar 16 to be loaded on the housing 50. The loading elements 90 also facilitate retaining the locking collar 16 on the housing 50, as will be described below. In the exemplary embodiment, the loading elements 90 include recesses 92 that extend radially inwardly relative to the central longitudinal axis 54. The recesses 92 are configured to receive the projections 40 of the locking collar 16 therein. The recesses 92 enable the locking collar 16 to be loaded on the housing 50 by allowing the projections 40 of the locking collar 16 to pass through the recesses 92 as the locking collar 16 is loaded on the housing 50. In addition or alternative to the projections 40 and recesses 92, the retaining flange 84 may include one or more projections (not shown) that pass through one or more recesses (not shown) of the locking collar 16. The retaining flange 84 may include any number of the loading elements 90.

Figure 5:
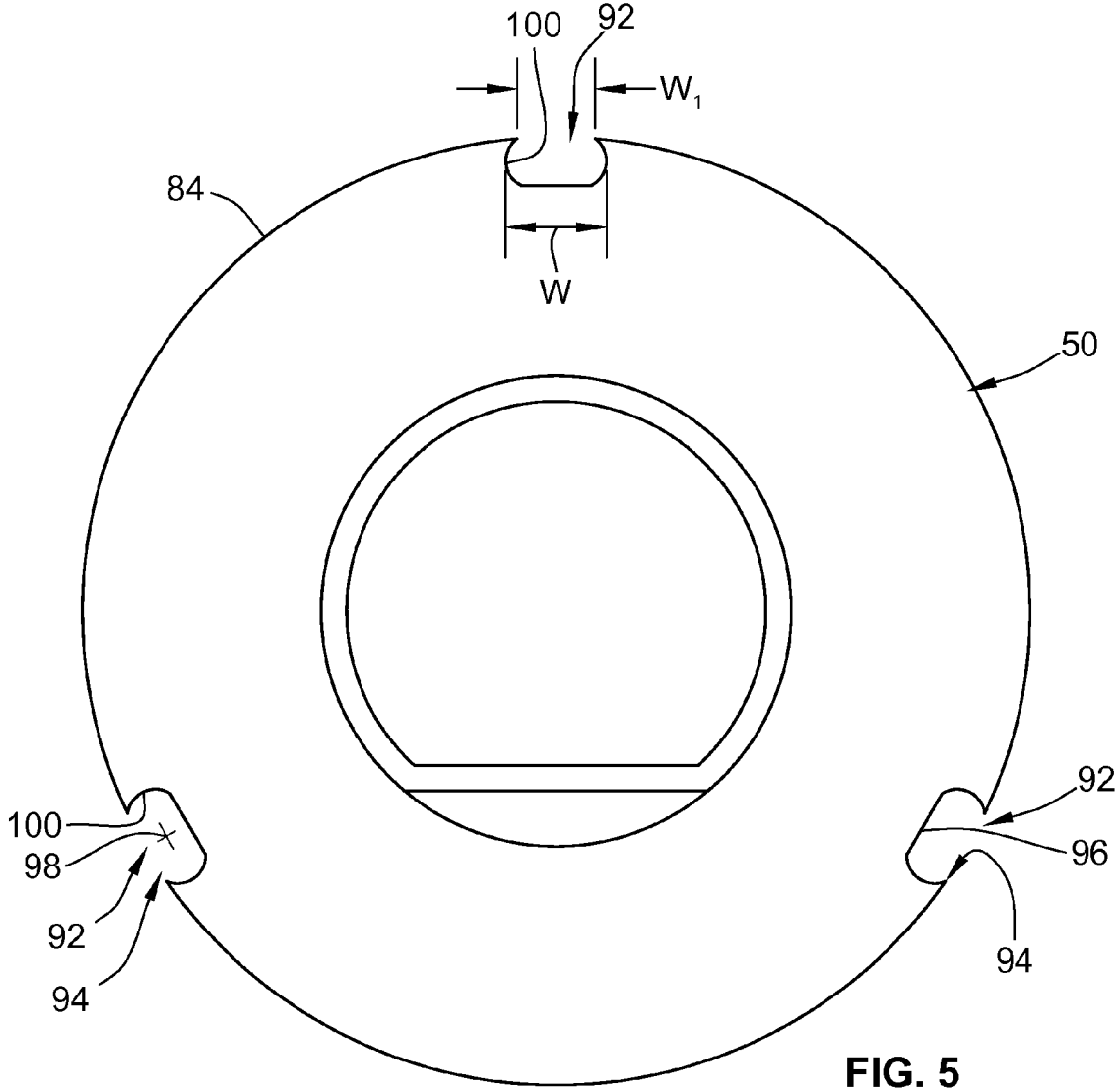
FIG. 5 is an elevational view of the housing of the electrical connector shown in FIGS. 1, 3, and 4.

FIG. 5 is an elevational view of an exemplary embodiment of the housing 50 illustrating the recesses 92. Each recess 92 extends a depth radially inwardly from an open end 94 to a bottom 96. Each recess 92 also extends a length along a central longitudinal axis 98 completely through the retaining flange 84. In the exemplary embodiment, a portion of the sidewalls 100 of each recess 92 have a greater width W than a width $W_1$ of the recess 92 at the open end 94. In other words, the sidewalls 100 of the recess 92 flair outwardly relative to the central longitudinal axis 98 as the recess 92 extends the depth into the retaining flange 84, before curving inwardly to intersect the bottom 96. Instead of curving inwardly at the intersection with the bottom 96, one or more of the sidewalls 100 of one or more of the recesses 92 may intersect the bottom 96 at a pointed edge (not shown). Moreover, one or more of the sidewalls 100 of one or more of the recesses 92 may alternatively flair inwardly relative to the central longitudinal axis 98 as the recess 92 extends the depth into the retaining flange 84, whether or not the sidewall 100 intersects the bottom 96 at a curved edge or a pointed edge. Further, one or more of the sidewalls 100 of one or more of the recesses 92 may alternatively extend an approximately constant distance from the central longitudinal axis 98 as the recess 92 extends the depth into the retaining flange 84, whether or not the sidewall 100 intersects the bottom 96 at a curved edge or a pointed edge.

The recesses 92 include an at least partially complementary shape relative to the projections 40 (FIGS. 3, 4, and 6) of the locking collar 16 (FIGS. 1, 3, 4, and 6) to enable the recesses 92 to receive the projections therein. In some embodiments, one or more of the recesses 92 may have a different shape than one or more of the other recesses 92 such that the recess 92 is not complementarily shaped relative to each of the projections 40. In such an embodiment, the projections 40 of the locking collar 16 may need to be aligned with corresponding ones of the recesses 92 to load the locking collar 16 on the housing 50. In other words, the recesses 92 and projections 40 may provide keying functions that prevent the locking collar 16 from being loaded on the housing 50 unless the locking collar 16 is in a predetermined rotational position relative to the housing 50. In addition or alternatively to the exemplary shape of the recesses 92 shown herein, each recess 92 may include any other shape so long as the recess 92 is shaped at least partially complementary relative to at least one of the projections 40.

Referring again to FIG. 4, the locking collar 16 is movably mounted on the housing 50. Specifically, when loaded on the housing 50, the body 34 of the locking collar 16 is rotatable relative to the housing 50 about the central longitudinal axis 54 of the housing 50 and the central longitudinal axis 36 of the locking collar 16. As can be seen in FIG. 4, the axes 36 and 54 are aligned when the locking collar 16 is loaded on the housing 50. The body 34 of the locking collar 16 is also linearly movable relative to the housing 50 along the axes 36 and 54. In other words, the body 52 of the housing 50 is movable linearly along the interior cavity 32 of the body 34 of the locking collar 16. The body 34 of the locking collar 16 includes an exterior surface 102 that is radially opposite the interior surface 38. The exterior surface 102 includes a plurality of optional grips 104 (FIG. 3) that facilitate rotating the locking collar 16 using a person's fingers and/or hand. When fully loaded on the housing 50 as shown in FIG. 4, the projections 40 of the locking collar 16 extend along the mating side 86 of the retaining flange 84.

The body 34 of the locking collar 16 extends a length along the central longitudinal axis 36 from a facing end 106 to a rear end 108. The body 34 of the locking collar 16 includes an inwardly directed shoulder 110 that engages the retaining flange 84 of the housing 50 when the locking collar 16 is loaded on the housing 50 and is mechanically connected to the mating connector housing 20 (FIGS. 1 and 2). Specifically, the shoulder 110 extends radially inward relative to the central longitudinal axis 36 and includes a surface 112 that is positioned to engage the rear side 88 of the retaining flange 84. An opening 114 extends through the shoulder 110. The opening 114 fluidly communicates with the interior cavity 32 of the body 34 of the locking collar 16. In the exemplary embodiment, the shoulder 110 extends radially inwardly at the rear end 108 of the body 34 of the locking collar 16. However, the shoulder 110 may additionally or alternatively extend radially inwardly outwardly along any other portion of the length of the body 34 of the locking collar 16, for example at a location(s) along the length of the body 34 that is between the facing end 106 and the rear end 108.

The projections 40 of the locking collar 16 include an at least partially complementary shape relative to the recesses 92. Each projection 40 extends a height radially inwardly from a base 116 that intersects the interior surface 38 of the body 34 to an end 118. In the exemplary embodiment, the end 118 of each projection 40 has approximately the same width as the base 116, and a sidewall 120 of each projection 40 intersects the base 116 and the end 118 at a pointed edge. Alternatively, the base 116 of one or more of the projections 40 has a greater width than the end 118 of the projection 40, whether or not the sidewall 120 intersects the base 116 and/or the end 118 at a pointed or a curved edge. The end 118 of one or more of the projections 40 may also have a greater width than the base 116 of the projection 40, whether or not the sidewall 120 intersects the base 116 and/or the end 118 at a pointed or a curved edge. Although shown as having a circular shape, each projection 40 may additionally or alternatively include any other shape so long as the projection 40 is shaped at least partially complementary relative to at least one of the recesses 92. Examples of other shapes that may be included by the projections 40 include, but are not limited to, rectangular shapes, triangular shapes, and/or the like.

At least a portion of each recess 92 has a smaller dimension than at least one of the projections 40 such that the projections 40 are received within the recesses 92 in a press-fit relationship. In other words, as the projections 40 are passed through the recesses 92, the sidewalls 120 of the projections 40 interfere with the sidewalls 100 of the recesses 92. The interference provides a force that resists the passing of the projections 40 through the recesses 92. The projections 40 therefore engage the recesses 92 in a press-fit relationship. Moreover, as the locking collar 16 is mounted on the housing 50, the projections 40 can be considered to engage the retaining flange 84 of the housing 50 in a press-fit relationship. In the exemplary embodiment, a width $W_2$ of each projection 40 is greater than the width $W_1$ (FIG. 5) of the sidewall 100 of the recess 92 at the open end 94. However, any portion of the projections 40 may have a greater dimension than any portion of the recesses 92 as long as each projection 40 engages at least one of the recesses 92 in a press-fit relationship.

Figure 6:
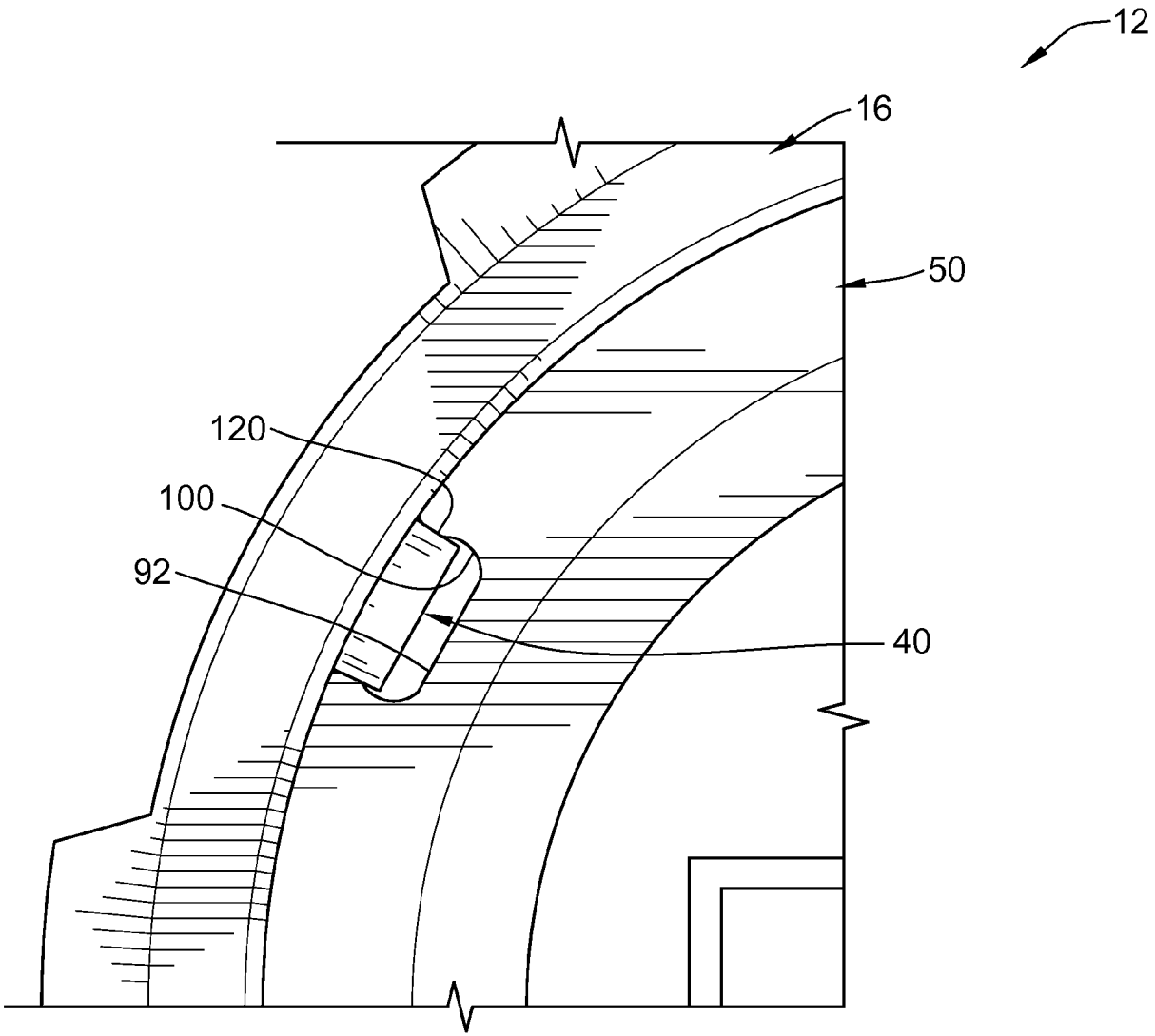
FIG. 6 is an enlarged perspective view of a portion of the electrical connector shown in FIGS. 1, and 3-5 illustrating an exemplary embodiment of a projection received within an exemplary embodiment of a recess.

FIG. 6 is an enlarged elevational view of a portion of the electrical connector 12 illustrating a projection 40 received within a recess 92. The sidewall 120 of the projection 40 interferes with the sidewalls 100 of the recess 92. The dimensional difference between the projections 40 and the recesses 92 may be selected to provide a predetermined resistive force to the passing of the projections 40 through the recesses 92. In other words, the relative size of the projections 40 and the recesses 92 may be selected such that a predetermined push/pull force must be applied to the locking collar 16 relative to the housing 50 to push or pull the projections 40 through the recesses 92. The resistive force and/or push/pull force is optionally selected as a force that does not damage and/or plastically deform the projections 40 and/or the recesses 92 as the projections 40 are passed through the recesses 92. Alternatively, the resistive force and/or push/pull force may be selected as a force that does damage and/or plastically deform the projections 40 and/or the recesses 92, for example to facilitate preventing the locking collar 16 from being unloaded from the housing 50. The dimensional difference between the projections 40 and the recesses 92 may be any difference that provides any desired resistive and/or push/pull force. In some embodiments, the dimensional difference between the projections 40 and the recesses 92 is between approximately 0.01 millimeters and approximately 1 millimeter. Moreover, in some embodiments, the dimensional difference between the projections 40 and the recesses 92 is between approximately 0.01 millimeters and approximately 0.1 millimeters. Further, in some embodiments, the dimensional difference between the projections 40 and the recesses 92 is between approximately 0.01 millimeters and approximately 0.5 millimeters. The specific dimensional differences recited in this paragraph are meant as exemplary only. Any portion of the projections 40 may have any value of dimensional difference relative any portion of the recesses 92 that provides any desired resistive and/or push/pull force.

Referring again to FIG. 3, an unloaded stage is illustrated wherein the locking collar 16 is unloaded from the housing 50. To load the locking collar 16 on the housing 50, the locking collar 16 is loaded over the closed end 58 of the housing 50 in the direction of the arrow A. Specifically, the closed end 58 of the housing 50 is inserted into the interior cavity 32 of the locking collar 16 and the locking collar 16 is moved along the central longitudinal axis 54 of the housing 50 in the direction of the arrow A. The locking collar 16 is rotatably positioned about the central longitudinal axis axes 36 and 54 relative to the housing 50 such that the projections 40 are aligned with the recesses 92. A push/pull force in the direction of the arrow A is applied to the locking collar 16 relative to the housing 50 to overcome the resistive force caused by the interference between the projections 40 and the recesses 92 and thereby pass the projections 40 through the recesses 92.

Once the projections 40 have passed through the recesses 92, the locking collar 16 is fully loaded on the housing 50, as is shown in FIGS. 1 and 4. Referring to FIG. 4, when the locking collar 16 is fully loaded on the housing 50, the locking collar 16 extends around the body 52 of the housing 50 and the projections 40 extend along the mating side 86 of the retaining flange 84. Moreover, a distal segment 122 of the housing 50 that includes the closed end 58 projects through the opening 114 within the shoulder 110 and beyond the rear end 108 of the locking collar 16.

When the projections 40 are not aligned with the recesses 92, engagement between the projections 40 and the retaining flange 84 facilitates retaining the locking collar 16 on the housing 50. When the projections 40 are aligned with the recesses 92, the resistive force caused by the interference between the projections 40 and the recesses 92 facilitates retaining the locking collar 16 on the housing 50. In other words, in order to remove the locking collar 16 from the housing 50, an adequate alignment and push/pull force must be applied to the locking collar 16 relative to the housing 50 to overcome the resistive force and enable the projections 40 to pass through the recesses 92.

Referring again to FIG. 1, once the locking collar 16 is fully loaded on the housing 50, the connectors 12 and 14 may be mated together and the locking collar 16 may be mechanically connected to the mating connector housing 20. When the connectors 12 and 14 are mated together and the locking collar 16 is fully engaged with the mating connector housing 20, the retaining flange 84 (FIGS. 3-5) of the housing 50 is engaged with and held between the shoulder 110 (FIG. 4) of the locking collar 16 and the mating face 27 (FIG. 2) of the mating connector housing 20. When the locking collar 16 is fully engaged with the mating connector housing 20, the connectors 12 and 14 are locked together.

The embodiments described and/or illustrated herein provide an electrical connector assembly that is less costly, less complex, and/or takes less time to assemble than at least some known electrical connector assemblies.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Similarly, the terms "front", "rear", "top", "bottom", and "side" etc. in the claims are used merely as labels, and are not intended to impose orientational requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector for mating with a mating connector, said electrical connector comprising:

a housing and an electrical contact held by the housing, the housing having a mating end that faces the mating connector when the electrical connector is mated with the mating connector, the housing comprising a body having a retaining flange; and a locking collar movably mounted on the body of the housing, the locking collar comprising a locking element and an inwardly directed shoulder having an opening extending therethrough, the locking element being configured to engage the mating connector to lock the electrical connector to the mating connector, the shoulder engaging the retaining flange of the body when the locking collar is fully engaged with the mating connector, the retaining flange of the body configured to engage the locking element of the locking collar to retain the locking collar on the body of the housing, wherein the retaining flange of the body comprises a recess, the locking element of the locking collar comprising a projection configured to be received within the recess in a press fit relationship.

2. The electrical connector according to claim 1, wherein the retaining flange of the body comprises a recess, the locking element of the locking collar comprising a projection configured to be received within the recess, the recess comprising a dimension smaller than at least a portion of the projection such that the recess and projection interfere with each other when the projection is received within the recess.

3. The electrical connector according to claim 1, wherein the retaining flange of the body extends comprises a mating side and an opposite rear side, the locking element of the locking collar extending along the mating side of the retaining flange when the locking collar is fully loaded on the body of the housing.

4. The electrical connector according to claim 1, wherein the locking collar comprises an interior cavity, the body of the housing extending at least partially through the interior cavity and being movable linearly along the interior cavity.

5. The electrical connector according to claim 1, wherein the locking collar extends a length from a facing end to a rear end, the shoulder extending inwardly at the rear end of the locking collar.

6. The electrical connector according to claim 1, wherein the body of the housing comprises a distal segment that projects through the opening within the shoulder of the locking collar and beyond a rear end of the locking collar when the locking collar is fully engaged with the mating connector.

7. The electrical connector according to claim 1, wherein the body of the housing comprises a closed end remote from the mating interface, the body having an interior chamber configured to hold an electrical component.

8. The electrical connector according to claim 1, wherein the locking element of the locking collar is configured to engage the mating connector in a bayonet connection.

9. The electrical connector according to claim 1, wherein the locking element of the locking collar is configured to engage the retaining flange of the body of the housing in a press-fit relationship during loading of the locking collar on the body of the housing.

10. The electrical connector according to claim 1, wherein the retaining flange of the body comprises a recess, the locking element of the locking collar comprising a projection configured to be received within the recess.

11. An electrical connector for mating with a mating connector, said electrical connector comprising:

a housing and an electrical contact held by the housing, the housing having a mating end that faces the mating connector when the electrical connector is mated with the mating connector, the housing comprising a retaining flange having a loading element; and a locking collar movably mounted on the housing, the locking collar comprising a locking element configured to engage the mating connector to lock the electrical connector to the mating connector, the locking element of the locking collar and the loading element of the retaining flange configured to engage each other in a press-fit relationship for loading and retaining the locking collar on the housing.

12. The electrical connector according to claim 11, wherein the loading element of the retaining flange comprises a recess, the locking element of the locking collar comprising a projection configured to be received within the recess.

13. The electrical connector according to claim 11, wherein the loading element of the retaining flange comprises a recess, the locking element of the locking collar comprising a projection configured to be received within the recess, the recess comprising a dimension smaller than at least a portion of the projection such that the recess and projection interfere with each other when the projection is received within the recess.

14. The electrical connector according to claim 11, wherein the retaining flange of the housing comprises a mating side and an opposite rear side, the locking element of the locking collar extending along the mating side of the retaining flange when the locking collar is fully loaded on the housing.

15. The electrical connector according to claim 11, wherein the locking collar comprises an interior cavity, the housing extending at least partially through the interior cavity and being movable linearly along the interior cavity.

16. The electrical connector according to claim 12, wherein the locking collar comprises an inwardly directed shoulder having an opening extending therethrough, the shoulder engaging the retaining flange of the housing when the locking collar is fully engaged with the mating connector.

17. The electrical connector according to claim 11, wherein the housing comprises a distal segment that projects beyond a rear end of the locking collar when the locking collar is fully engaged with the mating connector.

18. The electrical connector according to claim 11, wherein the retaining flange of the housing comprises a recess configured to receive the locking element of the locking collar, the recess extending from an open end to a bottom, the bottom comprising a greater width than the open end.

19. The electrical connector according to claim 11, wherein the locking element of the locking collar is configured to engage the mating connector in a bayonet connection.

* * * * *